United States Patent [19]

Everett et al.

[11] 4,379,263

[45] Apr. 5, 1983

[54] ENGINE ANALYZERS

[75] Inventors: Geoffrey J. Everett, Somerton; Christopher J. Hunt, Tiverton, both of England

[73] Assignee: TI Crypton Limited, Bridgewater, England

[21] Appl. No.: 210,528

[22] Filed: Nov. 25, 1980

[30] Foreign Application Priority Data

Nov. 27, 1979 [GB] United Kingdom ..... 7940836

[51] Int. Cl.[3] ..... F02P 17/00

[52] U.S. Cl. ..... 324/379; 324/384; 324/394; 324/399; 324/402

[58] Field of Search ..... 324/379, 394, 402, 384, 324/399

[56] References Cited

U.S. PATENT DOCUMENTS

| | | | |
|---|---|---|---|
| 2,645,751 | 7/1953 | Byerlay | 324/379 X |
| 2,791,745 | 5/1957 | Ramsay | 324/379 |
| 3,175,149 | 3/1965 | Whaley | 324/394 |
| 3,221,545 | 12/1965 | Traver | 324/379 X |
| 3,409,824 | 11/1968 | Makuh | 324/379 |
| 3,619,767 | 11/1971 | Pelta et al. | 324/379 X |
| 3,714,499 | 1/1973 | Pelta et al. | 324/379 X |
| 3,798,965 | 3/1974 | Pelta et al. | 324/379 X |

*Primary Examiner*—Stanley T. Krawczewicz
*Attorney, Agent, or Firm*—Kemon & Estabrook

[57] ABSTRACT

An engine analyzer, for analyzing ignition voltage or current signals in an engine of the kind in which each spark plug is fed with a succession of pulses, alternate pulses producing real sparks to ignite the petrol/air mixture, the other pulses producing wasted sparks at a point of the engine operating cycle remote from ignition, the analyzer including circuitry to pass the real spark pulse and inhibit passage of the wasted spark pulses.

9 Claims, 10 Drawing Figures

PRIOR ART

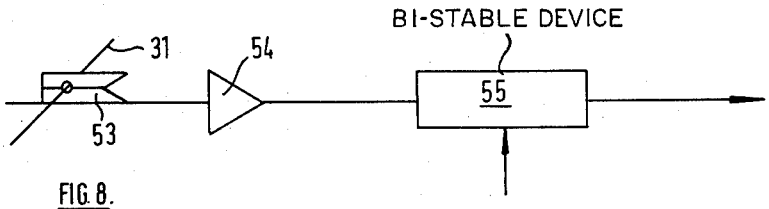
FIG. 8.
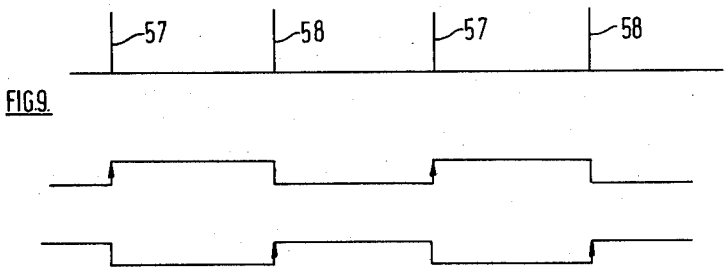
FIG.9.
FIG.10.
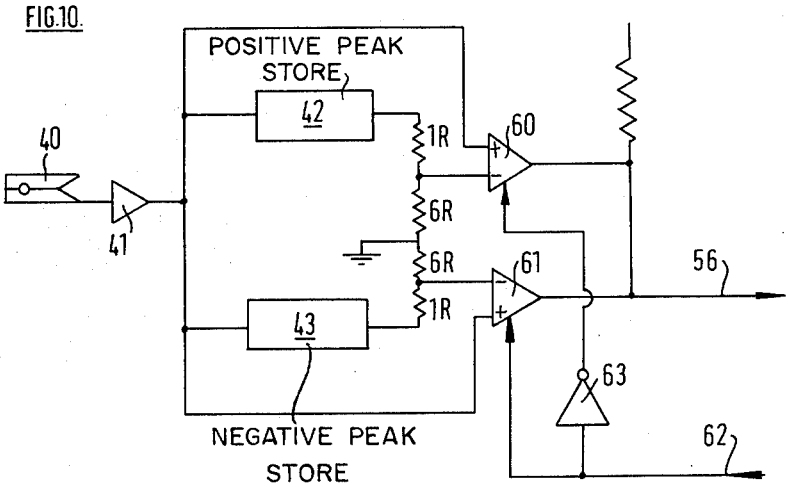

ENGINE ANALYZERS

This invention relates to engine analysers for spark ignition internal combustion engines.

According to the invention there is provided an engine analyser, adapted to process ignition voltage or current signals from the spark plug or the lead feeding that spark plug of a spark ignition internal combustion engine of the kind in which said signals comprise a succession of alternating real and wasted sparks as hereinafter defined, said analyser including a probe to be connected to the spark plug or lead, the probe emitting an input signal to the analyser representative of the ignition voltage or current, and circuitry to pass those pulses of the input signal representative of the real spark and to inhibit passage of those pulses of the input signal representative of the wasted spark.

Preferably the said circuitry includes rejection means arranged to inhibit passage of those pulses from said probe which do not reach a predetermined magnitude. The predetermined magnitude may be a predetermined percentage of the magnitude of and less than the previous pulse from said probe.

Conveniently the engine analyser includes a store capable of holding the peak magnitude of each pulse, a voltage divider network fed from said store and having an output applying a fixed percentage of the voltage held by the store to one input of a comparator, a line feeding the input signal to the store to another input of the comparator, and an output of the comparator on which output signals will appear only when the magnitude of one pulse exceeds the fixed percentage of the magnitude of the previous pulse, retained by the store.

Advantageously the circuit comprising the store, voltage divider and comparator is duplicated in parallel, each of said circuits taking pulses of different polarity, and invertor means arranged to invert the pulses of one of the polarities so as to emit a stream of pulses all of the same polarity each corresponding to a real spark pulse irrespective of the polarity of the real spark pulse.

According to a feature of the invention, a triggering pulse is derived from one or more of the pulses.

Preferably the stream of pulses comprising alternate real and wasted spark pulses are fed to a bistable device which emits pulses of which the rising edges correspond to the real spark pulses and the falling edges correspond to the wasted spark pulses or vice versa and triggering is initiated by the rising edges or alternatively by the falling edges.

The triggering pulse may be derived from the real spark.

For this purpose the bistable device may be controlled by the output of said store, voltage divider and comparator network so as to ensure that triggering is initiated by real spark pulses only.

Figure 1:
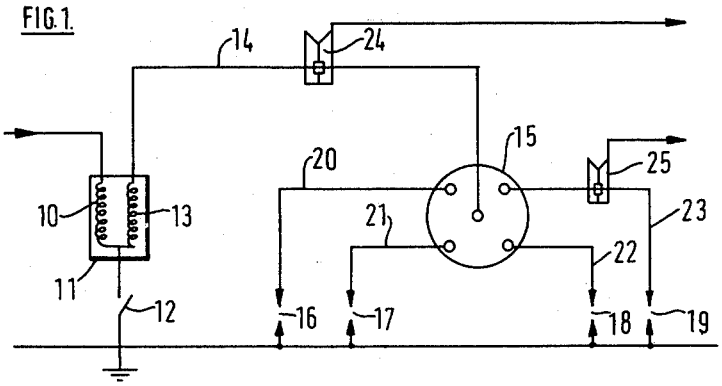
PRIOR ART FIG. 1.
Figure 2:
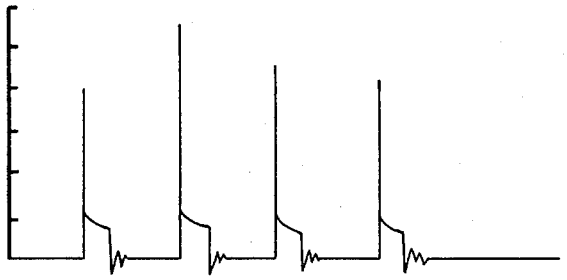
PRIOR ART FIG. 2.
Figure 3:
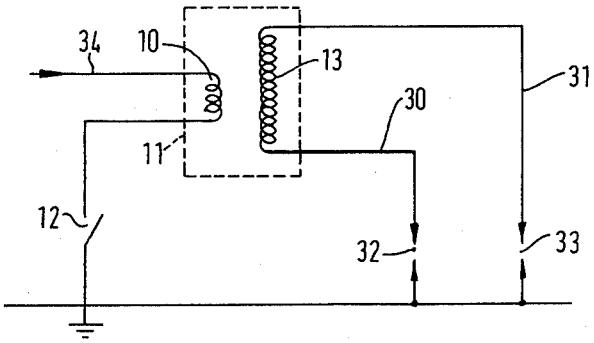
PRIOR ART FIG. 3.
Figure 4:
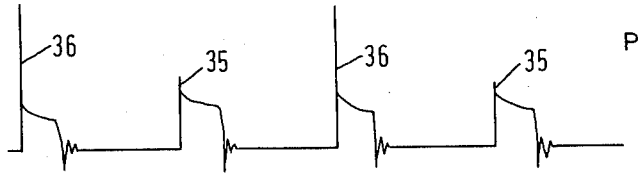
Figure 5:
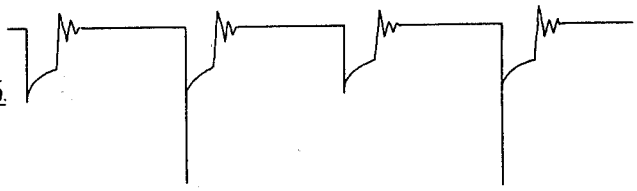
PRIOR ART FIG. 5.
Figure 6:
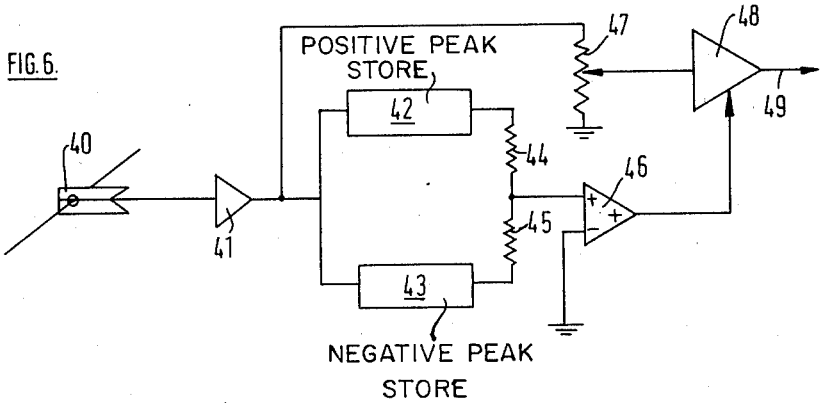
Figure 7:
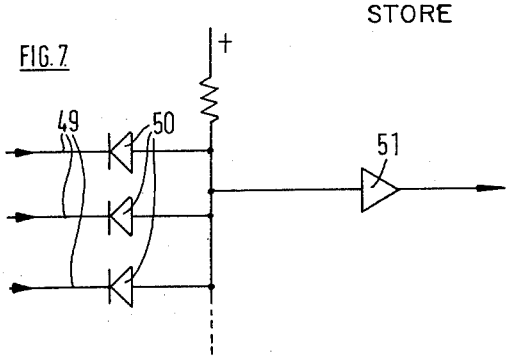

The invention is described, by way of example only, with reference to the accompanying drawings, in which:

FIG. 1 is a circuit diagram of part of a conventional spark ignition circuit for a 4 cylinder, 4 stroke internal combustion engine, FIG. 2 is a display of ignition voltage against time occurring in part of FIG. 1, FIG. 3 is a circuit diagram of part of a spark ignition circuit for a 2 cylinder, 4 stroke internal combustion engine, FIG. 4 is a display of ignition voltage against time occurring in part of FIG. 3, FIG. 5 is a display of ignition voltage against time occurring in another part of FIG. 3, FIG. 6 is a circuit diagram of part of an engine analyser, according to the invention, adapted to process the voltages shown in FIG. 4 or FIG. 5, FIG. 7 is a circuit diagram of another part of the engine analyser, FIG. 8 is a circuit diagram of a further part of the engine analyser, FIG. 9 is a display of voltages occurring in FIG. 8, FIG. 10 is a further circuit diagram of part of the engine analyser.

FIG. 1 shows, in diagramatic form, part of the ignition system of a typical 4-cylinder spark ignition engine. Current through the low-voltage winding (10) of the ignition coil (11) is interrupted at appropriate times by a contact-breaker (12) to induce high-voltage ignition pulses in the secondary winding (13) of the coil (11). These pulses are conducted by a "King" lead (14) to a distributor (15), in known way. Each of the cylinders of the engine is fitted with a sparking plug (16), (17), (18), (19), through leads (20), (21), (22), (23).

By inspecting, comparing and possibly utilising the high-voltage pulses fed in turn to the sparking plugs (16), (17), (18), (19), the condition of the ignition system and of the rest of the engine can be deduced. FIG. 2 shows a typical "parade" of the voltages applied to the sparking plugs, in which voltage is shown vertically against time horizontally, typically on a cathode ray oscilloscope. Often, a comparison of the relative heights of the voltage pulses is more important than their absolute values.

To achieve these known results it is known to reproduce the stream of pulses passing along the King lead (14), by means of a capacitive probe (24), clipped on the King lead (14). To synchronize the trace shown in FIG. 2, so that the first pulse is always, say, from No. 1 cylinder, it is known to take a synchronizing pulse from the lead (23) by means of another capacitive or inductive probe (25).

However, the type of ignition system described so far is not always used and FIG. 3 shows, again in diagramatic form, part of the ignition system commonly used on 2-cylinder engines, for example in some motor cars and on motor cycles. For engines having 4 or 6 cylinders, the circuit of FIG. 3 is duplicated or triplicated. For engines having more cylinders one circuit is added for each extra pair of cylinders. Although FIG. 3 shows the coil (11) and contact-breaker (12), there is no distributor (15). The secondary winding (13) is connected at each end with a high-voltage lead (30), (31), leading to respective sparking plugs (32), (33). Whereas in FIG. 1 the contact-breaker (12) operates normally at half engine rotation speed, in FIG. 3 it operates at engine rotation speed, so that each time a spark is produced at the correct time for ignition of a charge in one of the cylinders there will also be produced, at the same instant, a spark in the other cylinder at the end of the exhaust stroke and beginning of the induction stroke, on a 4-stroke cycle engine. The spark required for ignition is designated the "real" spark and the coincident spark in the other cylinder is called the "wasted" spark. It will be seen that the pulses in lead (31) will always be positive relative to earth and the pulses in lead (30) will always be negative relative to earth, or vice versa, depending on the polarity of the lead (34).

It will be seen that in this type of ignition system there is no King lead (14) along which all the ignition pulses pass. Therefore, it is necessary to affix a separate capacitive probe to each lead (30), (31), and in some way to combine the signals from both leads (30), (31), to generate a parade of the type shown in FIG. 2.

FIG. 4 shows a plot of voltage against time of the voltage in lead (31). It will be seen that due to the lower pressure in the cylinder during the wasted spark, the peak voltages of the wasted sparks (35), are lower than those of the real sparks (36).

FIG. 5 shows the voltage pattern in the lead (30), starting at the same time as FIG. 4. It will be seen that the pulses are all negative relative to earth in FIG. 5, whereas in FIG. 4 they are all positive. It will also be seen that in FIG. 5 each wasted spark coincides with a real spark of FIG. 4.

The first requirement is to invert the pulses of either FIG. 4 or FIG. 5, so that they can all be displayed in the same sense and thus be directly compared, as in FIG. 2. As mentioned above, for each lead of the 2 or more cylinders there is provided a preferably capacitive probe (40), in FIG. 6.

For each probe (40) there is provided a circuit of the type shown in FIG. 6, comprising a buffer amplifier (41), feeding a positive peak store (42) and a negative peak store (43), arranged in parallel. The outputs of the peak stores (42), (43), combine through resistors (44), (45), to feed the positive input of a comparator (46), which is arranged to emit a signal only when the input peaks are positive.

The output signal from the buffer amplifier (41) feeds, through a scaling potentiometer (47), to the input of an inverting amplifier (48), which only inverts the pulses when it is fed by a signal from the comparator (46). Therefore, when the pulses are negative the comparator (46) emits no signal, so that the pulses pass straight through the invertor (48). On the other hand, when the pulses are positive, the comparator (46) will emit a signal which will cause the invertor (48) to invert the positive input pulses and emit negative output pulses.

It will be seen that the outputs of all the invertors (48) will always be negative pulses, which could be superimposed on a time base to give a parade of the pulses to all the cylinders, as in FIG. 2. However, if the pulses in FIG. 4 are inverted and super-imposed on the pulses of FIG. 5, the pulse of each real spark will be added to the pulse of a wasted spark at the same time. FIG. 7 shows a circuit for eliminating the wasted spark pulses, so that only the real spark pulses constitute the parade. In FIG. 7 each output (49) from each invertor (48) feed through a diode (50), before joining at the input of a further amplifier (51). Thus, a real spark pulse passing through one of the diodes (50) will inhibit conduction of any diode (50) which is fed with a wasted spark pulse. The amplifier (51) will, therefore, only emit the real spark pulses, to constitute the vertical voltages of the parade.

The horizontal sweep voltages are generated within the cathode ray equipment, in the usual way, but are triggered from No. 1 cylinder. For synchronization purposes the wave form of the current in the lead (31) is more reliable than the voltage wave form. Therefore, whereas a capacitive probe is generally used to derive the voltage pattern, an extra probe (53) in FIG. 8, of inductive type, is attached to the No. 1 cylinder lead (31). The pulses from the probe (53) are fed through a buffer amplifier (54) and through a bi-stable device (55). The positive edge of the bi-stable output is used to initiate the horizontal sweep.

FIG. 9 shows that without a synchronising pulse applied to the control input (56) of the bi-stable device (55), two timing sequences are possible, one with the trace synchronised to the real spark pulses (57) and the other synchronised to the wasted spark pulses (58).

FIG. 10 shows a synchronisation circuit which is fed from the capacitive probe (40) on the lead to No. 1 sparking plug only. The amplifier (41) and peak stores (42) and (43), are those used in FIG. 6. Further outputs from the stores (42), (43) are fed through voltage-dividing resistors, as shown in FIG. 10, to feed 2 further comparators (60), (61). The output signal from the comparator (46) is fed along line (62) to the comparator (61), and also through an invertor (63) to the comparator (60). The signal in line (62) is used to inhibit the comparator (61), when the input signal is positive. The inverted signal from invertor (63) is used to inhibit the comparator (60) when the input signal is negative.

If the signal from the probe (40) comprises a train of positive pulses, as in FIG. 4, the positive peak detector (42) will hold to the maximum value of the real spark. 80% of this value is applied to the comparator (60) as a reference. Thus only real spark signals will give synchronisation pulses along line (56), since wasted spark voltages will generally be below the reference amplitude. The actual value of the percentage selected depends on the relative values of the real and wasted sparks.

The real spark synchronizing pulses can be used for other purposes e.g. measuring spark advance angle by comparison with a crankshaft position generated pulse.

At low engine speeds, i.e. less than 2,000 r.p.m., the real spark is significantly greater than the wasted spark. Above this speed real and wasted sparks may become of comparable amplitude under certain engine conditions.

To ensure that this is not a problem the synchronisation circuit is only allowed to operate below engine speeds of 2,000 r.p.m., for example by using a tachometer range change relay (unshown) as a switch.

The analyser described above may be adapted for use on distributorless engine ignition equipment, such as certain transistorised types, where the circuit is enclosed in a box of which the only output comprises the leads to the spark plugs, i.e. there is no single output lead along which all of the ignition pulses pass.

Although the invention has been described with reference to a four stroke engine it is equally useful for analysing the performance of multi-cylinder two stroke cycle engines. It is particularly useful for analysing the kind in which an ignition spark occurs twice at each spark plug at each revolution of the engine. In each cylinder one of the sparks occurs near top dead centre and the next spark occurs near bottom dead centre, so that the latter alternate sparks occur near the end of the power stroke. The analyser described above for a four stroke cycle engine is thus able to display all of the voltage signals intended to ignite mixture in the cylinders but not to display voltage signals associated with the said alternate sparks, which occur near the end of the power strokes.

Instead of displaying the magnitude of the voltage pulses on a cathode ray oscilloscope, the information can be presented in any other appropriate manner, for example on one or more meters, a visual display unit, histogram display, digital display, etc.

The construction of the capacitive probe (24), inductive probe (25), buffer amplifier (41), peak stores (42), (43), comparators (46), (60) and (61), invertors (48) and (63), diode (50), amplifier (51), bi-stable device (55) are all well known to those skilled in the art and need not be described further.

Instead of displaying the ignition voltage traces of two or more cylinders at the same time on the oscilloscope it is occasionally required to display the whole voltage trace of a selected cylinder over the whole of its working cycle and then to be able to switch the analyser to display whole voltage trace of a different cylinder for comparison. The analyser described above enables such a mode of working with the advantage that all of the successive displays are presented in the same polarity.

Although the use of the extra probe (53) has been described as providing more reliable synchronization, in some circumstances the signal from one of the capacitive probes (40), or from an extra capacitive probe (53) can be utilised.

We claim:

1. An engine analyser, adapted to process ignition voltage or current signals from a pair of engine components comprising the spark plug and the lead feeding that spark plug of a spark ignition internal combustion engine of the kind in which said signals comprise a succession of alternating real and wasted sparks, said analyser including a probe to be connected to one component of said pair of components, for emitting an input signal to the analyser representative of the ignition voltage or current, circuitry means connected between said probe and said analyser which will pass those pulses of the input signal representative of the real spark and to inhibit passage of those pulses of said input signal representative of the wasted spark.

2. An engine analyser, as in claim 1, in which the said circuitry means includes rejection means arranged to inhibit passage of those pulses from said probe which do not reach a predetermined magnitude.

3. An engine analyser, as in claim 1, in which a triggering pulse is derived from one or more of the pulses.

4. An engine analyser, as in claim 3, in which the stream of pulses comprising alternate real and wasted spark pulses are fed to a bistable device which emits pulses of which the rising edges correspond to the real spark pulses and the falling edges correspond to the wasted spark pulses or vice versa and triggering is initiated by the rising edges or alternatively by the falling edges.

5. An engine analyser, as in claim 4, in which the triggering pulse is derived from a pulse representative of the real spark.

6. An engine analyser, as in claim 4, in which the bistable device is controlled by the output of said store, voltage divider and comparator network so as to ensure that triggering is initiated by real spark pulses only.

7. An engine analyser, adapted to process ignition voltage or current signals from a pair of engine components comprising the spark plug and the lead feeding that spark plug of a spark ignition internal combustion engine of the kind in which said signals comprise a succession of alternating real and wasted sparks, said analyser including a probe to be connected to one component of said pair of components, the probe emitting an input signal to the analyser representative of the ignition voltage or current, said probe being connected to circuitry means which will pass those pulses of the input signal representative of the real spark and will inhibit passage of those pulses of the input signal representative of the wasted spark connected between said probe and said analyser, said circuitry further including rejection means arranged to inhibit passage of those pulses from said probe which do not reach a magnitude which is a predetermined percentage of the magnitude of, and less than, the previous pulses from said probe.

8. An engine analyser, as in claim 7, including a store capable of holding the peak magnitude of each pulse, a voltage divider network fed from said store and having an output comprising a fixed percentage of the voltage held by the store, a comparator having one input fed by said output, a line feeding the input signal to the store to another input of the comparator, and an output of the comparator on which output signals will appear only when the magnitude of one pulse exceeds the fixed percentage of the magnitude of the previous pulse, retained by the store.

9. An engine analyser, as in claim 8, in which the circuit comprising the store, voltage divider and comparator is duplicated in parallel, each of said circuits taking pulses of different polarity, and invertor means arranged to invert the pulses of one of the polarities so as to emit a stream of pulses all of the same polarity each corresponding to a real spark pulse irrespective of the polarity of the real spark pulse.

* * * * *